US007370837B2

(12) United States Patent
Zander

(10) Patent No.: US 7,370,837 B2
(45) Date of Patent: May 13, 2008

(54) MODEL RAILROAD SWITCH MACHINE

(76) Inventor: Dennis R. Zander, 35 Rolling Meadows Way, Penfield, NY (US) 14526

( * ) Notice: Subject to any disclaimer, the term of this patent is extended or adjusted under 35 U.S.C. 154(b) by 114 days.

(21) Appl. No.: 10/949,507

(22) Filed: Sep. 24, 2004

(65) Prior Publication Data

US 2006/0065790 A1 Mar. 30, 2006

(51) Int. Cl.
*A63H 19/00* (2006.01)

(52) U.S. Cl. ..... 246/415 A

(58) Field of Classification Search ..... 246/415 R, 246/415 A, 220, 476, 277, 314, 258, 263, 246/253, 240

See application file for complete search history.

(56) References Cited

U.S. PATENT DOCUMENTS

| | | | | |
|---|---|---|---|---|
| 1,548,940 | A * | 8/1925 | Gill | 246/231 |
| 4,307,302 | A * | 12/1981 | Russell | 307/40 |
| 4,355,776 | A * | 10/1982 | Rydin | 246/415 A |
| 5,050,823 | A | 9/1991 | Parker | |
| 5,085,148 | A | 2/1992 | Konno | |
| 5,251,856 | A | 10/1993 | Young | |
| 5,492,290 | A | 2/1996 | Quinn | |
| 5,590,856 | A | 1/1997 | Quinn | |
| 5,752,678 | A | 5/1998 | Riley | |
| 6,039,291 | A * | 3/2000 | Dobson, IV | 246/219 |
| 6,123,298 | A | 9/2000 | Riley | |
| 6,308,920 | B1 * | 10/2001 | Zander | 246/415 A |
| 6,441,570 | B1 | 8/2002 | Grubba | |
| 6,445,150 | B1 | 9/2002 | Tanner | |
| 6,696,805 | B2 | 2/2004 | Tanner | |
| 2003/0155470 | A1 | 8/2003 | Young | |

OTHER PUBLICATIONS

Stan Ames et al, Digital Command Control—the comprehensive guide to DCC-, 1998, pp. 2, 14, 30, 37-39, 84-85, 90-91 and 93-95.*
The Digitrax—Big Book of DCC, pp. 56-58, Digitrax, Inc. 1999.*

* cited by examiner

*Primary Examiner*—Mark T. Le
(74) *Attorney, Agent, or Firm*—Stephen B. Salai; Brian B. Shaw; Harter Secrest & Emery LLP

(57) ABSTRACT

A switch machine for a model railroad layout includes a unidirectional motor, a switch actuator coupled to the motor and movable between two switch positions by rotation of the motor, a sensor coupled to the switch actuator for sensing the position of the switch actuator, and a controller connected to the motor and the sensor and having a power input and at least a single wire control input, the controller responsive to a first control signal to activate the motor to move the switch actuator from a first position to a second position at a slow speed simulating an actual railroad switch, and responsive to a second control signal to move the switch actuator from a first position to a second position at a fast speed to avoid a derailment.

35 Claims, 16 Drawing Sheets

MODEL RAILROAD SWITCH MACHINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING"

Not applicable.

BACKGROUND OF THE INVENTION

1. Field of the Invention

This invention relates in general to model railroad switch machines and more particularly to a model railroad switch machine having a single wire control input, user programmable synchronization of indicator lights, realistic slow speed switching action simulating the operation of full size railroad switches and self calibration for enhancing realism as switch mechanical resistance and voltage changes are encountered.

2. Description of Related Art

Known switch machines or switch actuators for model railroad applications take a variety of forms. Solenoids are commonly used to actuate the switches because they are small and efficient and can provide relatively high power. One problem with solenoid actuators is that they produce a snap action that is effective for moving the switch but which is not very realistic. Switch machines for actual locomotives use relatively large, slow moving motors and changing the position of a switch typically takes several seconds. It is desirable for enhancing realism to provide a switch machine for a model railroad layout that also moves the switch slowly to more accurately simulate a real switch.

Switch machines have been proposed that employ a rack and pinion assembly connected to a small motor for driving the switch. While these have the ability to provide a realistic switching speed, they add a level of complexity. The motor must be driven in one direction to move the switch one way and reverse to move the switch the other way. This adds complexity and cost to the controller and multiplies the number of wires that must be run to the switch machine. It is desirable to have a switch machine that uses the minimum possible number of control wires.

Model train switching machines frequently include signals, most often light signals, for indicating the position of the switch. Such light signals are important because the position of the switch is often difficult to see directly and a miss positioned switch could cause a derailment. While signal lights are known for use in model railroad switching machines, a problem not so far addressed is the problem of synchronizing the lights with the position of the switch especially when the model railroad switch machine is responsive to a switching signal to switch from whatever state it is presently in to the other state. A known solution to this problem is to make the lights, most often red and green lights, removable so that the lights can be removed and reinstalled such that the green light indicates that the switch is in the through position while the red light indicates that the switch is in the out position. It is desirable to provide a switch that can be synchronized without removing the lights and permitting the switch machine to be mounted on either side of the switch.

BRIEF SUMMARY OF THE INVENTION

Briefly stated and in accordance with a first aspect of a presently preferred embodiment of the invention, a switch machine for a model railroad layout includes a unidirectional motor, a switch actuator coupled to the motor and movable between two switch positions by rotation of the motor, a sensor coupled to the switch actuator for sensing the position of the switch actuator, and a controller connected to the motor and the sensor and having a power input and a single wire control input, the controller responsive to a first control signal to activate the motor to move the switch actuator from a first position to a second position at a slow speed simulating an actual railroad switch, and responsive to a second control signal to move the switch actuator from a first position to a second position at a fast speed to avoid a derailment.

In accordance with another aspect of the invention, the controller is responsive to the switch actuator to adjust the power provided to the motor to obtain a desired slow speed.

In accordance with another aspect of the invention, the controller is responsive to the input power to adjust the speed at which the motor drives the switch actuator.

In accordance with another aspect of the invention, a worm gear is attached to the motor and an edge gear is attached to the worm gear.

In accordance with another aspect of the invention, a pivotally mounted lever is coupled to the edge gear.

In accordance with another aspect of the invention, a pin on the edge gear engages a camming surface on the lever and the pin is movable along a plurality of apertures on the edge gear to control the distance through which the lever moves.

In accordance with another aspect of the invention, the sensor is coupled to the edge gear.

In accordance with another aspect of the invention, the switch machine is enclosed within a housing and the housing includes a push button mounted on the housing and connected to the controller.

In accordance with another aspect of the invention, the controller is responsive to the push button to change the position of the switch actuator.

In accordance with another aspect of the invention, the switch machine includes second and third inputs, for example inputs adapted to be connected to rail segments adjacent to switch, to cause the switch to change positions at a high speed.

In accordance with another aspect of the invention, the switch machine includes signal lights on the housing of the switch machine and a control is provided for synchronizing the signal lights with the position of the switch and the actuator.

In accordance with a further embodiment of the invention, the switch machine is addressable, that is it includes memory for storing an address and is responsive to signals addressed to it and ignores signals addressed to other switch machines.

In accordance with another aspect of the invention, the switch machine includes memory for storing route information and is responsive to receipt of a route signal to set the switch to a position stored with respect to the selected route.

BRIEF DESCRIPTION OF THE SEVERAL VIEWS OF THE DRAWING(S)

The novel aspects of the invention are set forth with particularity in the appended claims. The invention itself together with further objects and advantages thereof may be more readily comprehended by reference to the following detailed description of the invention taken in conjunction with the accompanying drawing in which:

FIG. 13 is a flow chart of another subroutine shown in FIG. 11; and

DETAILED DESCRIPTION OF THE INVENTION

Figure 1:
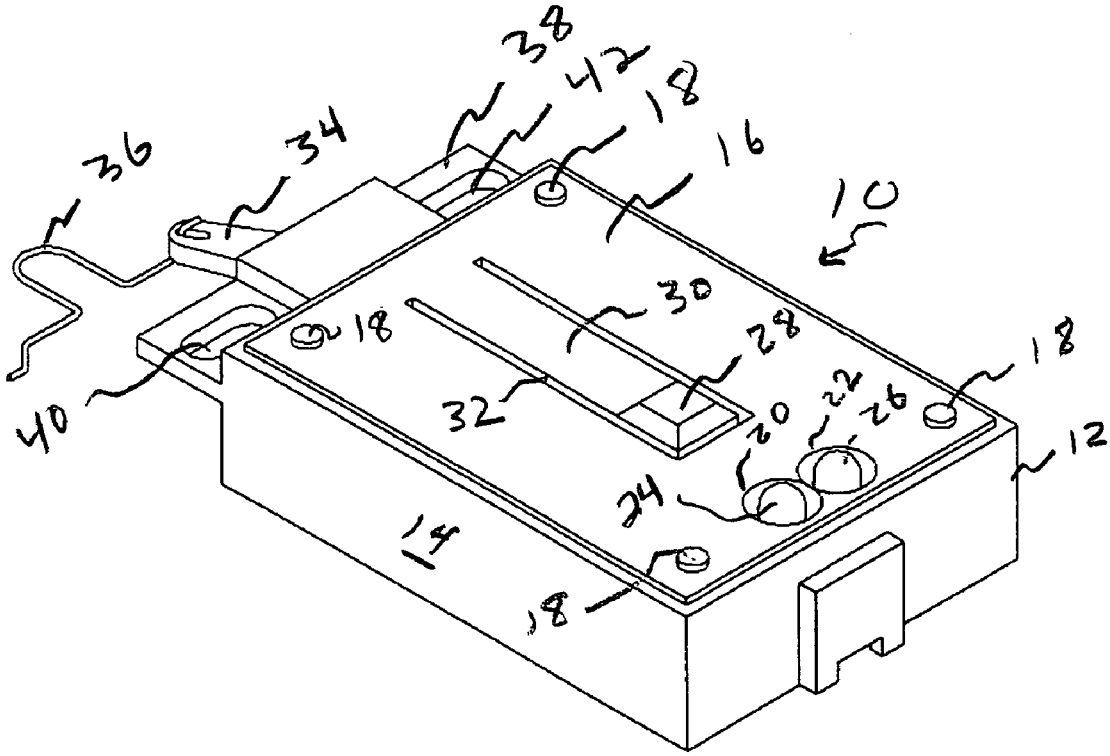
FIG. 1 is a perspective view of a switch machine in accordance with this invention.

Referring now to FIG. 1, the switch machine indicated generally at 10 is enclosed within a housing 12 preferably made from plastics or similar materials which includes a base 14 and a cover 16. The cover is attached to the base by fasteners 18 located at the corners of the cover 16. The cover is provided with apertures 20 and 22 for receiving signal lamps 24 and 26.

A push button 28 is formed in the cover 16 at the end of a cantilevered arm 30 formed in the cover plate 16 by a peripheral slot 32.

A switch actuator portion of the switch machine includes a pivotally mounted lever 34 extending from an end of housing 12 and connected to a linkage 36 which attaches the arm to a switch.

A mounting flange 38 extends from one end of the housing 12 and includes elongated apertures 40 and 42 for mounting the switch machine to a support for a model railroad layout.

Figure 2:
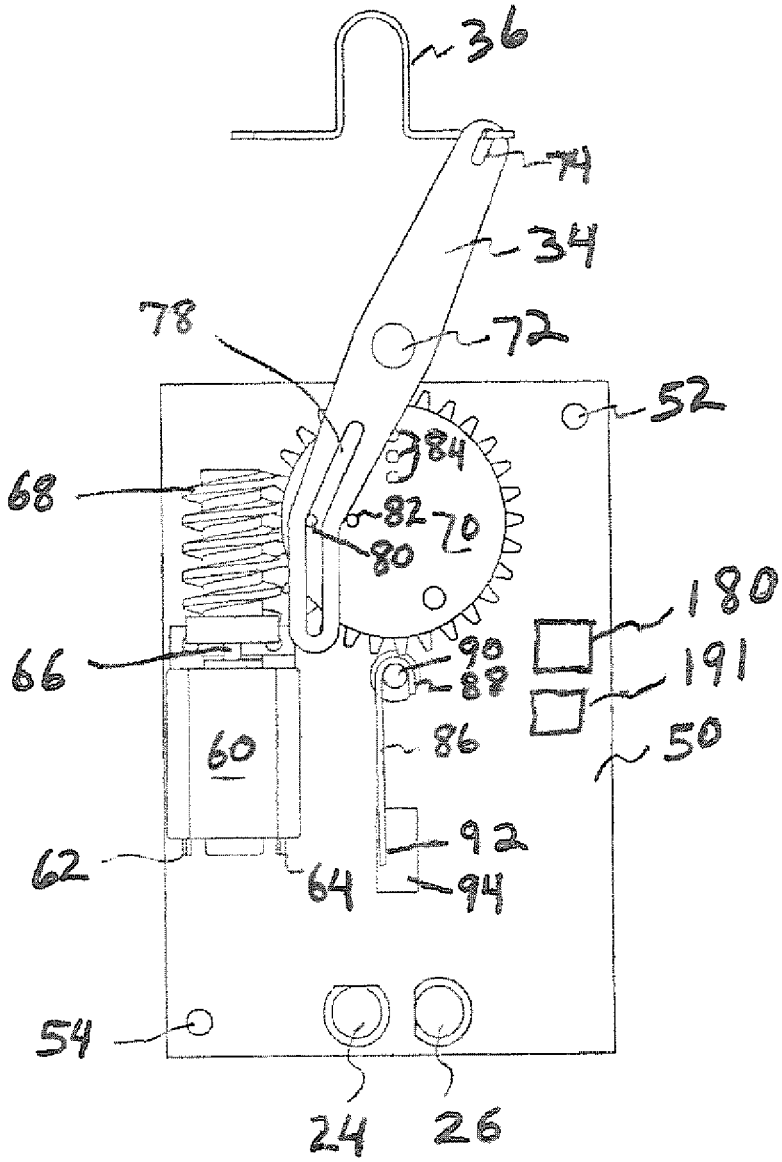
FIG. 2 is a top plan view of the internal elements of the switch machine of FIG. 1 shown in a first position.

FIG. 2 is a slightly simplified top plan view of the interior of the switch machine 10 with the switch actuator in a first position. The components of the switch machine are mounted on a circuit board 50 that fits within the housing and includes apertures 52 and 54 for receiving fasteners for securing the circuit board 50. Controller 180 and radio receiver 191 are shown in box diagram form to indicate that they are elements of the switch machine, but not to show any specific form or location. First and second signal lights 24 and 26 are provided for indicating the position of the switch actuator. Preferably, lights 24 and 26 are red and green light emitting diodes respectively, but other forms of lights or even non-illuminated signals could be used.

A motor 60 is mounted on circuit board 50. Electrical connection to the motor is made by way of leads 62 and 64 that are attached to traces (not shown) on the circuit board 50. The motor has an output shaft 66 on which a worm gear 68 is mounted. Worm gear 68 engages the peripheral teeth of a face gear 70.

Lever 34 is pivotally mounted to the housing on pivot post 72. The lever has a slot 74 at one end thereof that engages one end of linkage 36. The other end of lever 34 is bent in a dogleg fashion and includes camming slot 78 in which a pin 80 travels as the face gear 70 rotates. Aperture 82 is an alternate aperture for receiving pin 80.

A second plurality of apertures 84 is provided on face gear 70 for permitting the range of motion of lever 34 to be adjusted.

The electrical contact portion of push button 28 includes a resilient wire element 86 having a first end 88 bent around a contact post 90. A second end 92 is resiliently disposed over contact pad 94. When pushbutton 28 is pressed it engages wire 86 and causes end 92 to contact pad 94, completing an electrical circuit between post 90 and pad 94. When the pushbutton 28 is released, contact is broken.

Figure 3:
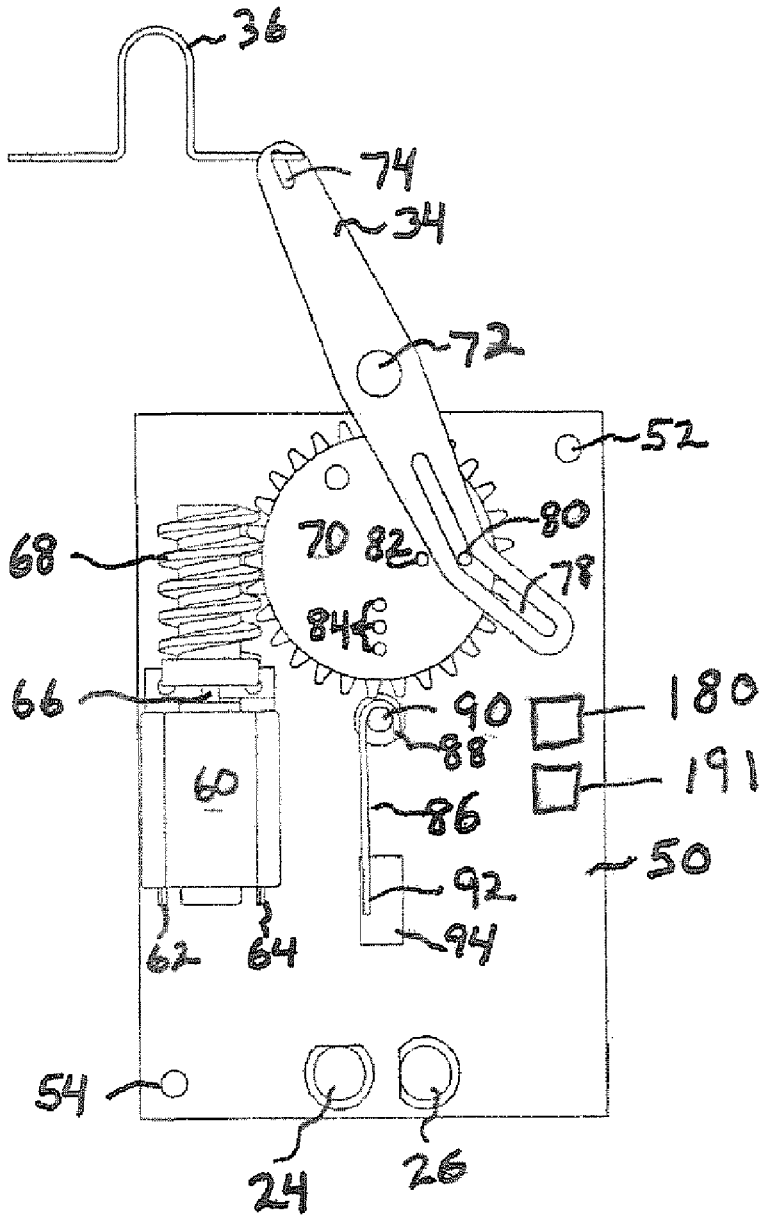
FIG. 3 is a top plan view of the internal elements of the switch machine in FIG. 1 shown in a second position.

FIG. 3 is another view of the interior of the switch machine substantially identical to FIG. 2 except that the lever 34 is shown in the other of two positions having been caused to pivot about post 72 by the rotation of face gear 70. The movement of the lever 34 has caused linkage 36 to move thereby actuating a switch to which the linkage is attached to move it from one position to another.

Figure 4:
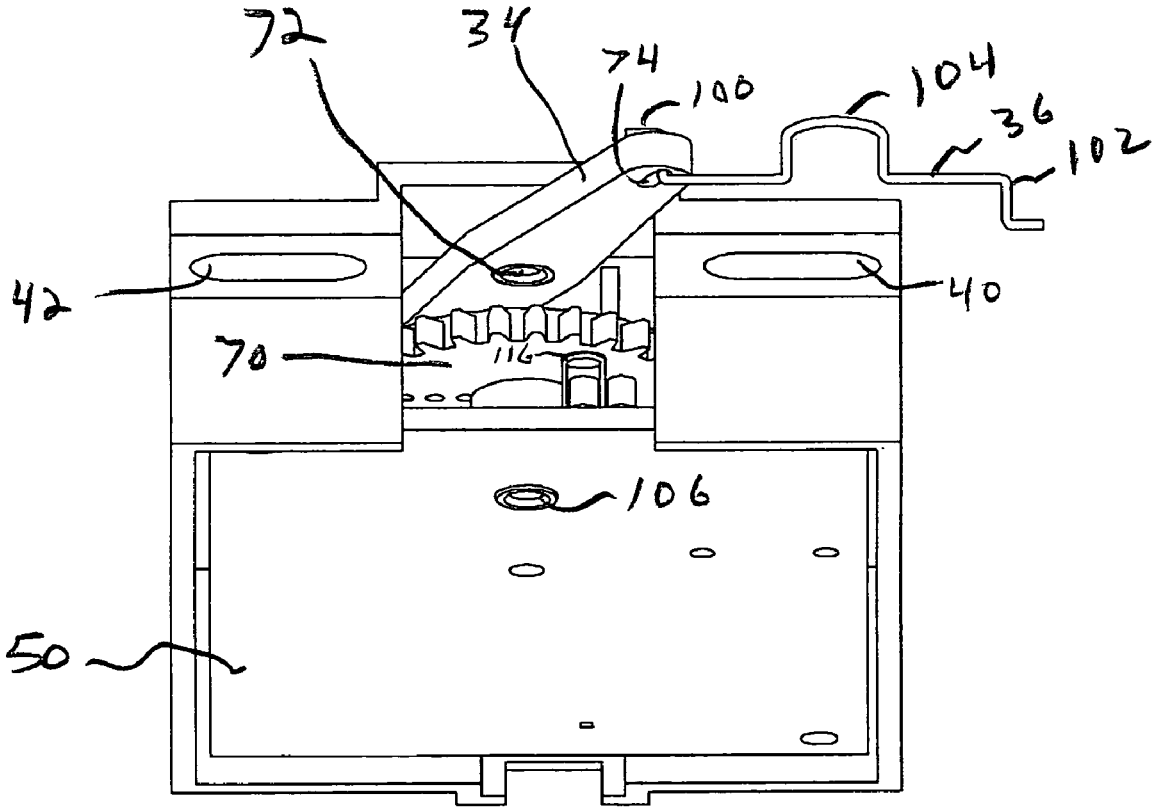
FIG. 4 is an end elevation of the switch machine of FIG. 1 shown in the second position.

FIG. 4 is end view of the switch machine taken at an oblique angle. The configuration of linkage 36 and the manner in which bent end 100 of the linkage engages slot 74 in the end of letter arm 34 can be more clearly seen. The linkage 36 includes a second bent end portion 102 adapted to the connected to a switch and a u-shaped central loop 104 for relieving stresses on the linkage 34.

The underside of pivot 72 on which lever 34 is mounted can be more clearly seen in this figure as can the pivot 106 on circuit board 50 on which face gear 70 rotates.

Figure 5:
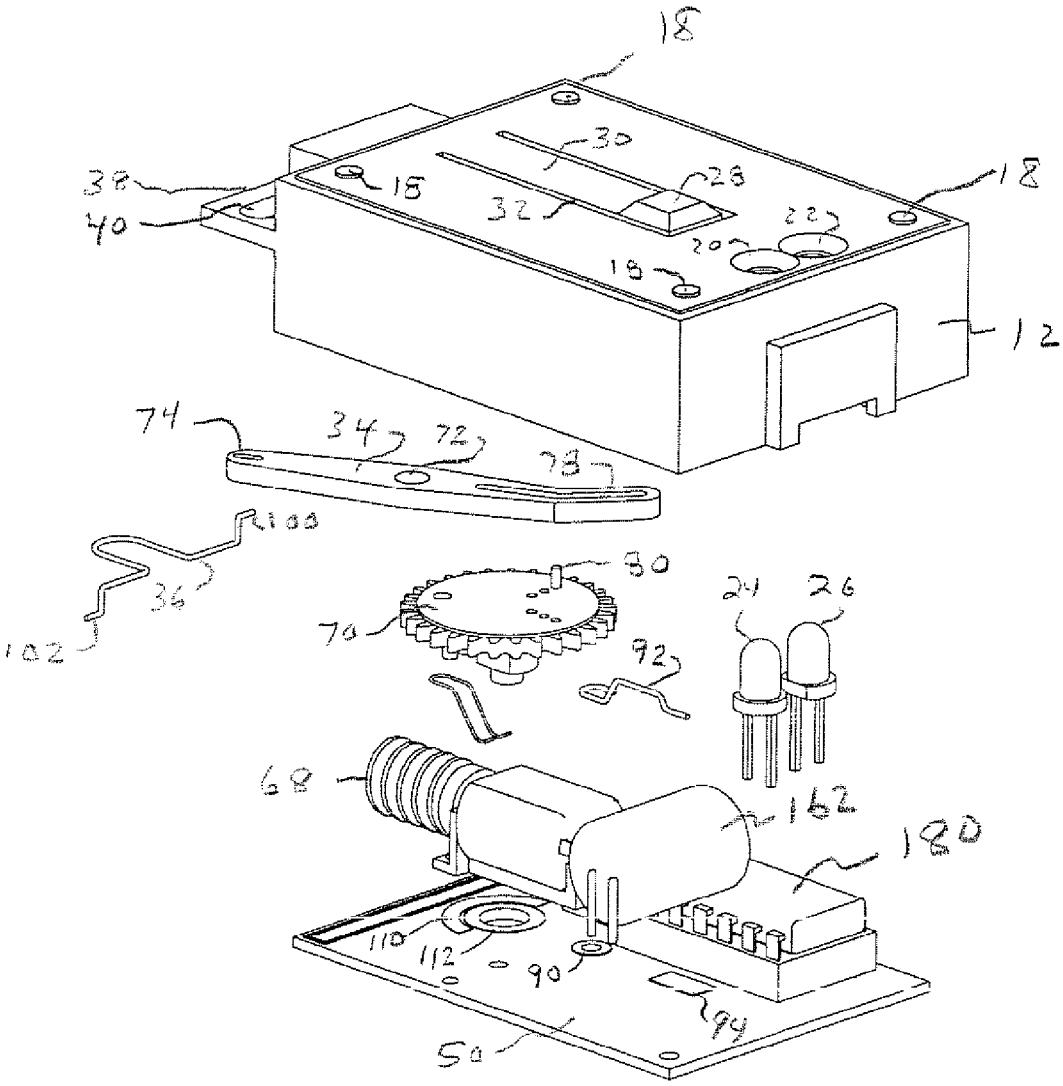
FIG. 5 is an exploded view of the switch machine of FIG. 1.

FIG. 5 is an exploded view of the switch machine of this invention in which many of the elements already described can be seen along with several new elements.

The switch machine also includes a sensor for sensing the position of the switch actuator. The sensor includes a first annular circuit trace on circuit board 50 aligned with the axis of face gear 70 and a second semi-circular trace 112 concentric with annular trace 110 but spaced radially outward therefrom.

A spring contact 114 formed in a generally u-shape has a flat portion 116 at the bight end thereof, and a ramp portion 118 leading to upturned end contact portions 120 and 122. The flat portion 116 is attached to and carried by face gear 70 so that upturned end portions 120 and 122 contact the annular contact 110 and semicircular contact 112 respectively. It can be seen that for approximately half the rotation of face gear 70, contact 114 bridges contacts 110 and 112 and forms a complete circuit therebetween while during the other approximately one-half the rotation of face gear 70 no contact is made to outer semicircular contact 112. This allows the position of the face gear and therefore the position of the lever 34 and linkage 36 to be sensed electrically.

Figure 6:
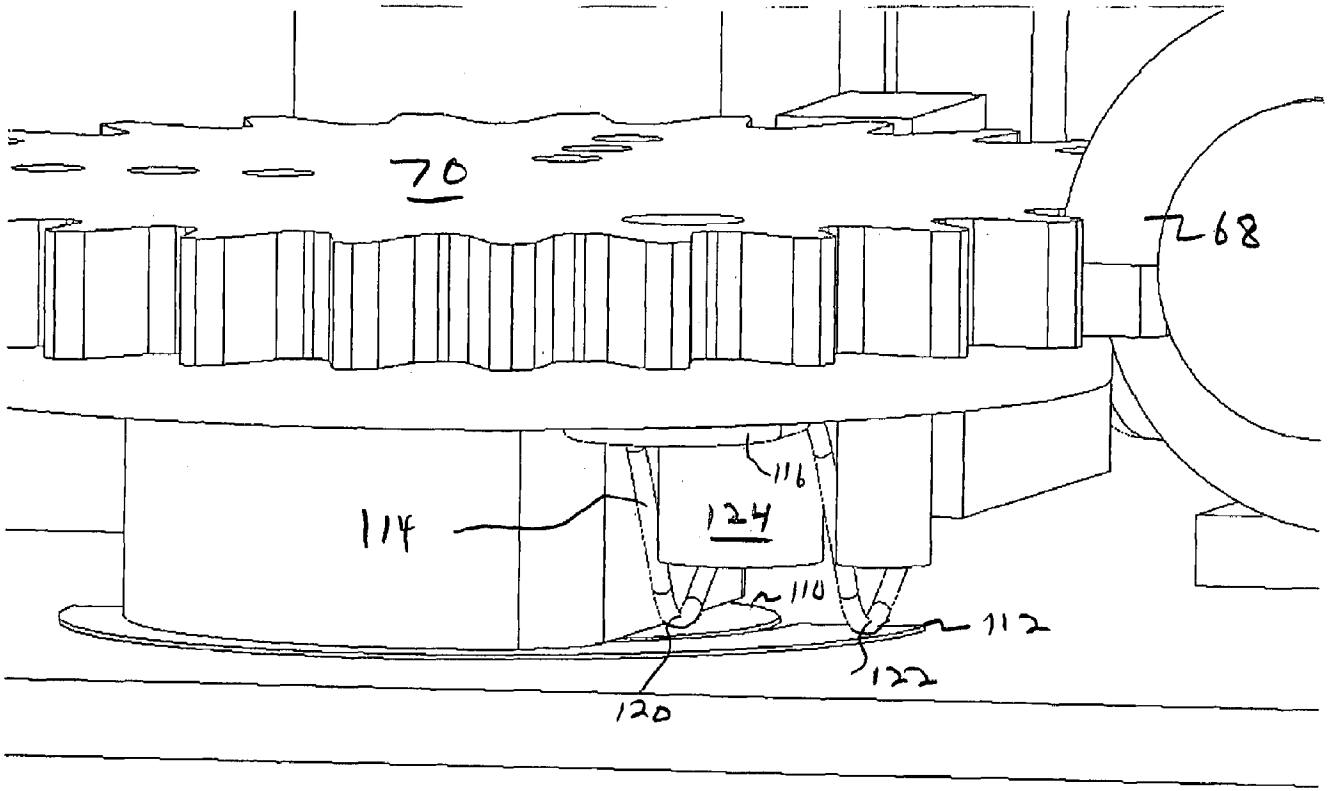
FIG. 6 is an enlarged fragmentary view of the switch machine of FIG. 1 showing the position sensor portion of the switch machine.

FIG. 6 is an enlarged fragmentary view showing the contact 114 is attached by a screw (not shown) and positioned by a boss 124 that depends downwardly from the undersurface of face gear 70.

Figure 7:
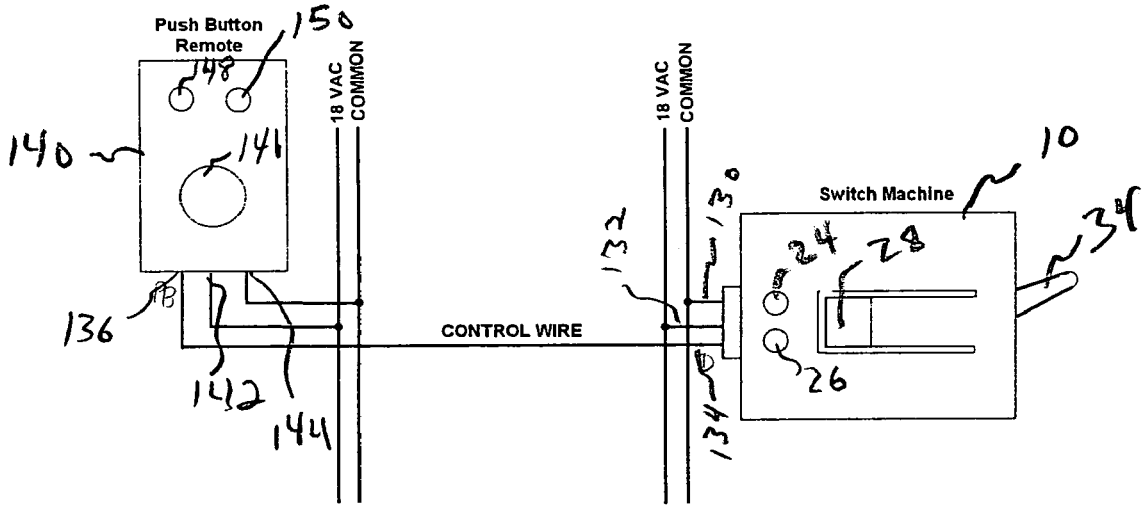
FIG. 7 is a block diagram schematic of the switch machine in accordance with this invention shown connected to a remote controller for the switch machine.

FIG. 7 is a block diagram schematic of a portion of a model railroad layout showing a switch machine in accordance with this invention and a remote control unit for operating the switch machine. The switch machine 10 has three input terminals, 132 and 134. input terminals 130 and 132 are connected to a common and 18 volt AC lines of a power bus that runs around the model railroad layout. These connections provide power to the switch machine but preferably do not provide any control signals. Input terminal 134 is a single wire control input that is connected to a corresponding control output 136 on a remote control unit 140. Remote control unit 140 is also connected to the common power bus by way of input terminals 142 and 144.

The remote control unit 140 has a push button actuator 146 and first and second LED indicators 148 and 150. The LED indicators are synchronized with the corresponding indicators 24 and 26 on the switch machine so that the indicators on the remote control unit show the position of the lever 34 on the switch machine. The construction of the controller for accomplishing this is described in more detail below.

Figure 8:
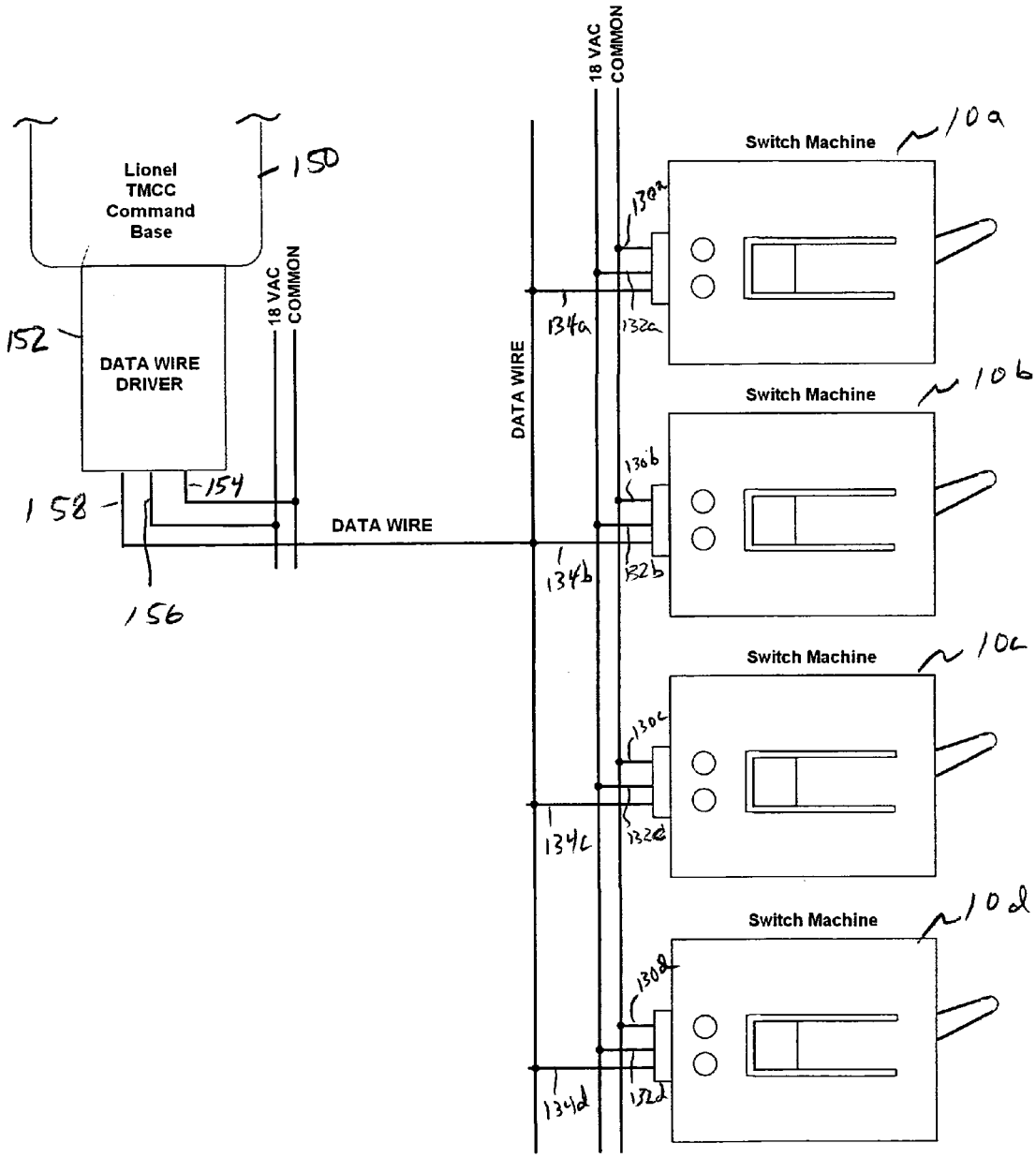
FIG. 8 is a block diagram schematic of a plurality of switch machines in accordance with this invention shown connected to a remote controller for the switch machines.

FIG. 8 is a simplified schematic diagram of a model railroad layout incorporating four switch machines in accordance with this invention. All controlled by a single controller. The switch machines 10*a*, 10*b*, 10*c* and 10*d*. Each of the switch machines is connected to the 18 VAC power bus by way of first input terminals 130*a*, 130*b*, 130*c* and 130*d* and second input terminals 132*a*, 132*b*, 132*c* and 132*d*.

The switch machines are connected to a common data bus by input terminals 134*a*, 134*b*, 134*c* and 134*d*.

The controller, preferably a Lionel TMCC Command Base 150 is connected via a data wired driver 152 to the AC power bus and the data bus by way of output terminals 154, 156 and 158 respectively.

Figure 9:
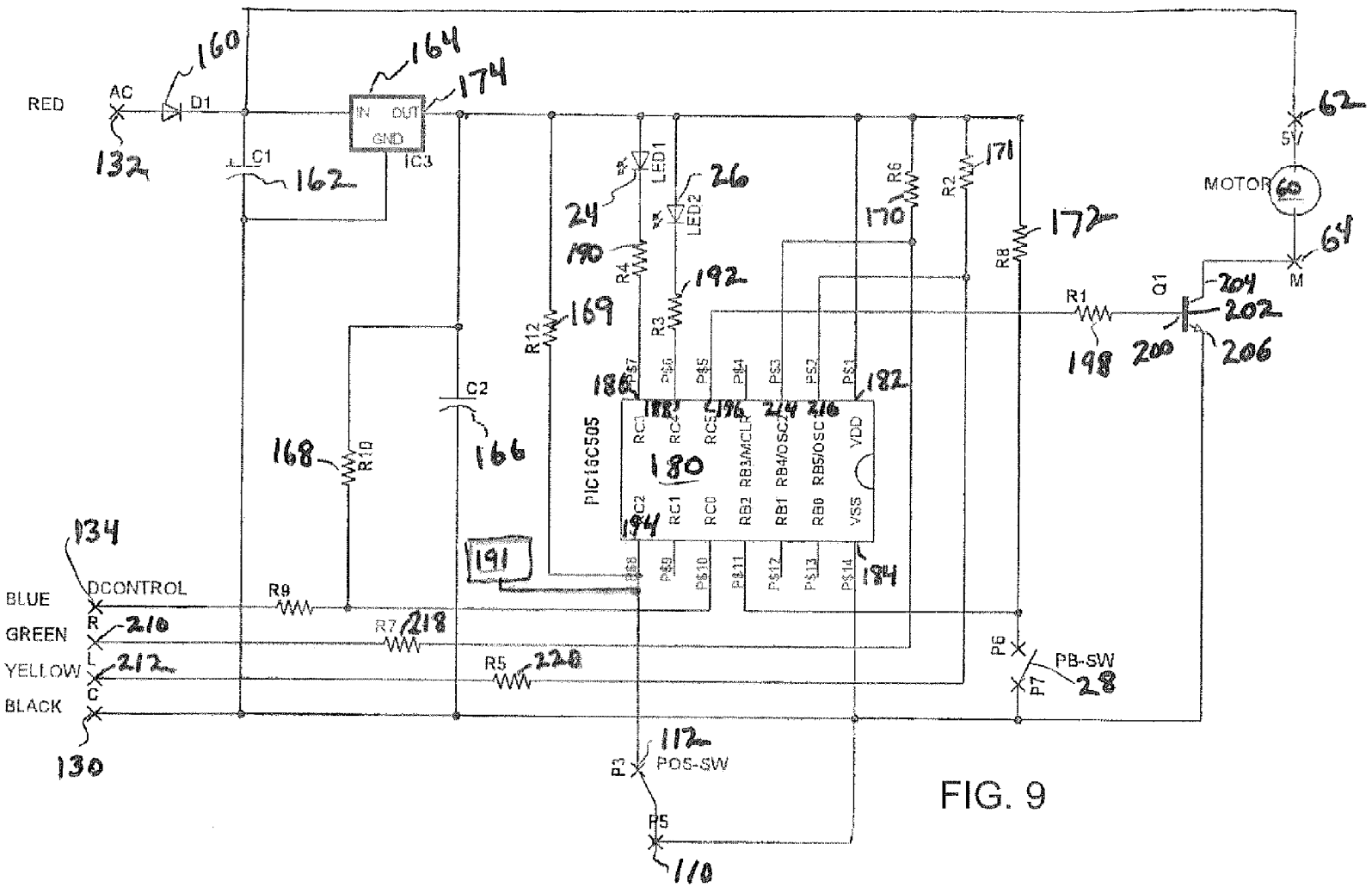
FIG. 9 is a schematic diagram of the switch machine in accordance with this invention.

FIG. 9 is a schematic diagram of the switch machine controller in accordance with the invention. Input terminal 132 is connected to the anode of diode 160. The cathode of diode 160 is connected to filter capacitor 162 whose other terminal is connected to common terminal 130. The cathode of diode 160 is also connected to a voltage regulator circuit preferably by an integrated solid state voltage regulator circuit 164 that provides operating voltage for the remaining controller. The output of voltage regulator 164 is filtered by capacitor 166. Pull up resistors 168 and 172 are all connected to the output 174 of voltage regulator 164. One terminal of motor 60 is also connected to the cathode of diode 160.

The controller is based on a solid state programmable controller 180 having a plurality of inter-programmable input and output terminals as will be described in more detail below and power terminals 182 connected to the output of voltage regulator 164 and 184 connected to common terminal 130. First and second output terminals 186 and 188 are connected to light emitting diodes 24 and 26 by way of current limiting resistors 190 and 192 respectively.

Position sensor terminal 112 is connected to input terminal 194 and position sensor terminal 110 is connected to common terminal 184. Pull up resistor 169 also connected to input terminal 194 maintains the input at a logical high level unless the position sensor is closed. Optionally, a radio frequency receiver 191 may be connected to the input.

Motor controller output 196 is connected thru series resistor 198 to the base 200 of motor driver transistor 202. The collector of transistor 202 is connected to motor terminal 64 and the emitter is connected to common terminal 130. Motor 60 is activated when a positive signal appears on output 196.

Pull up resistor 172 is connected to one terminal of push button switch 28. The other terminal is connected to common input terminal 130.

High speed switching inputs 210 and 212 of the controller are connected to input terminals 214 and 216 of controller 180 respectively and are held high by pull up resistors 170 and 171. Series resistors 218 and 220 are connected between input terminals 210 and 212 and the input terminals of controller 180

The operation of the controller will be explained in more detail below in connection with block diagrams showing the operation of the firmware encoded therein.

Figure 10:
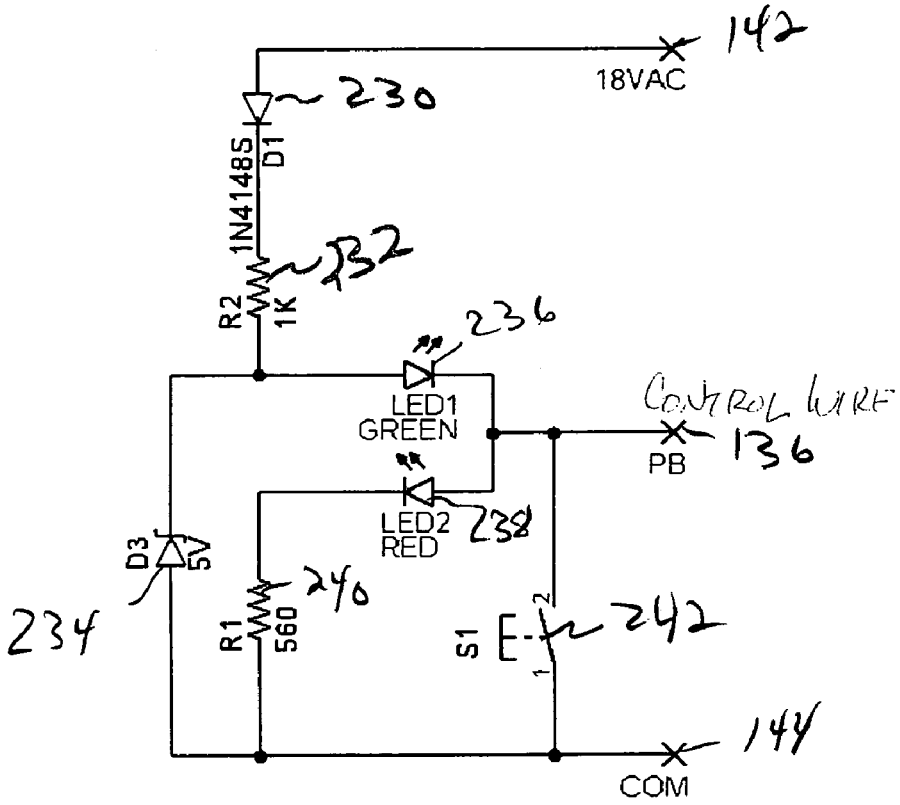
FIG. 10 is a schematic diagram of a simple remote control for a single switch machine in accordance with this invention.

FIG. 10 is a schematic diagram of remote control unit 140. Output terminal 142 is adapted to be connected to the ACV bus as shown in FIG. 7 and terminal 144 is adapted to be connected to the common wire of such bus. Output 136 is adapted to be connected to input 134 of the switch machine. The remote controller includes a rectifier diode 230 connected to output terminal 142 and a current limiting resistor 232 connected in series therewith. Resistor 232 is connected to zener diode 234 for establishing preferably a five volt level at the junction of the diode 234 and resistor 232.

First and second green and red light emitting diodes respectively are connected in a series with a current limiting resistor 240 across zener diode 234. Control output 136 is connected to the junction of the two light emitting diodes and push button switch 242 is connected between the control output 136 and common terminal 144.

Figure 11:
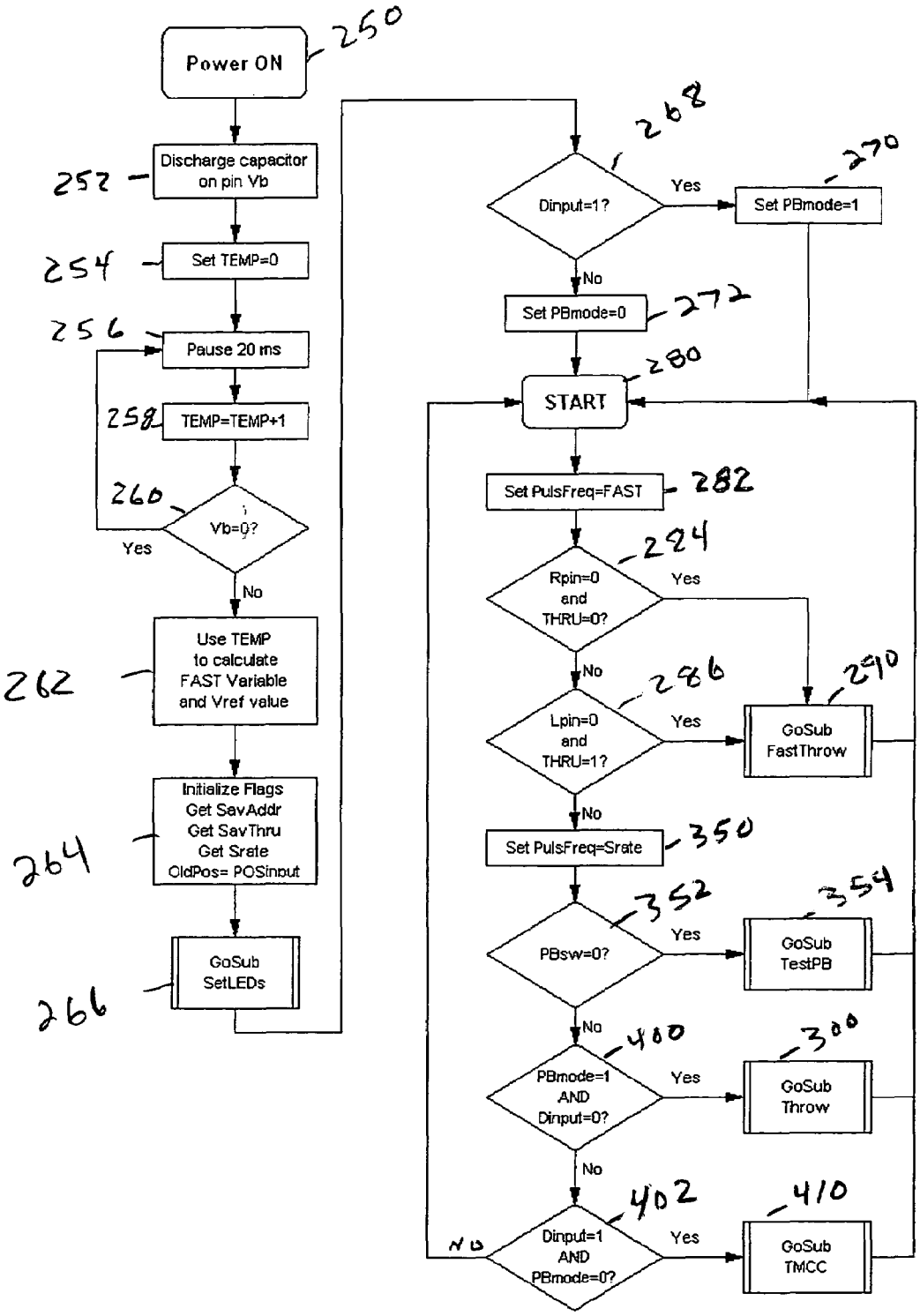
FIG. 11 is a flow chart showing the operation of the controller of a switch machine in accordance with the invention.

FIG. 11 is a flow chart showing the operation of controller 180 in connection with the inputs and outputs of the controller and the other components of the switch machine. In accordance with a preferred embodiment of the invention, controller 180 is a PIC16F684 CMOS flash programmable integrated circuit based on a micro controller manufactured by Microchip Technology, Inc. of Chandler, Ariz. Other controllers having similar features could also be used.

At power on 250, the controller is initialized as shown at 252.

The microprocessor pins are then configured as inputs/outputs and to set their normal value at high or low respectively.

The input and output ports are initialized, the initial motor pulse rate is set and the initial switch position is set to thru.

The input voltage to the controller is then tested. The input voltage is used to set an appropriate pulse rate for the motor. The higher the input voltage the lower the pulse rate.

The control voltage is measured in a loop consisting of steps 252-260 as follows. A capacitor attached to pin Vb of the microcontroller is discharged by setting pins Vb low as shown at step 252. A timing loop consisting of steps 254-260 is entered. A temporary variable is set to zero and a 20 millisecond delay is executed. The temporary variable is incremented and the voltage at pin Vb is sensed. The loop is repeated until input Vb is no longer equal to zero. The value of TEMP is inversely proportional to the supply voltage, a higher voltage will result in a shorter time for Vb to switch from zero to 1, or lower voltage will result in a longer time.

The value of TEMP is then used to calculate the value for fast which controls the motor drive when executing fast operation as will be discussed in more detail later. The value of Vref is set in the same step 262.

The state of the Dinput flag is then tested. If it is high at power on then the push button input mode is set at 270. If Dinput is low, then the PB input flag is set to 0 and Dinput will be tested for serial input as described.

Figure 13:
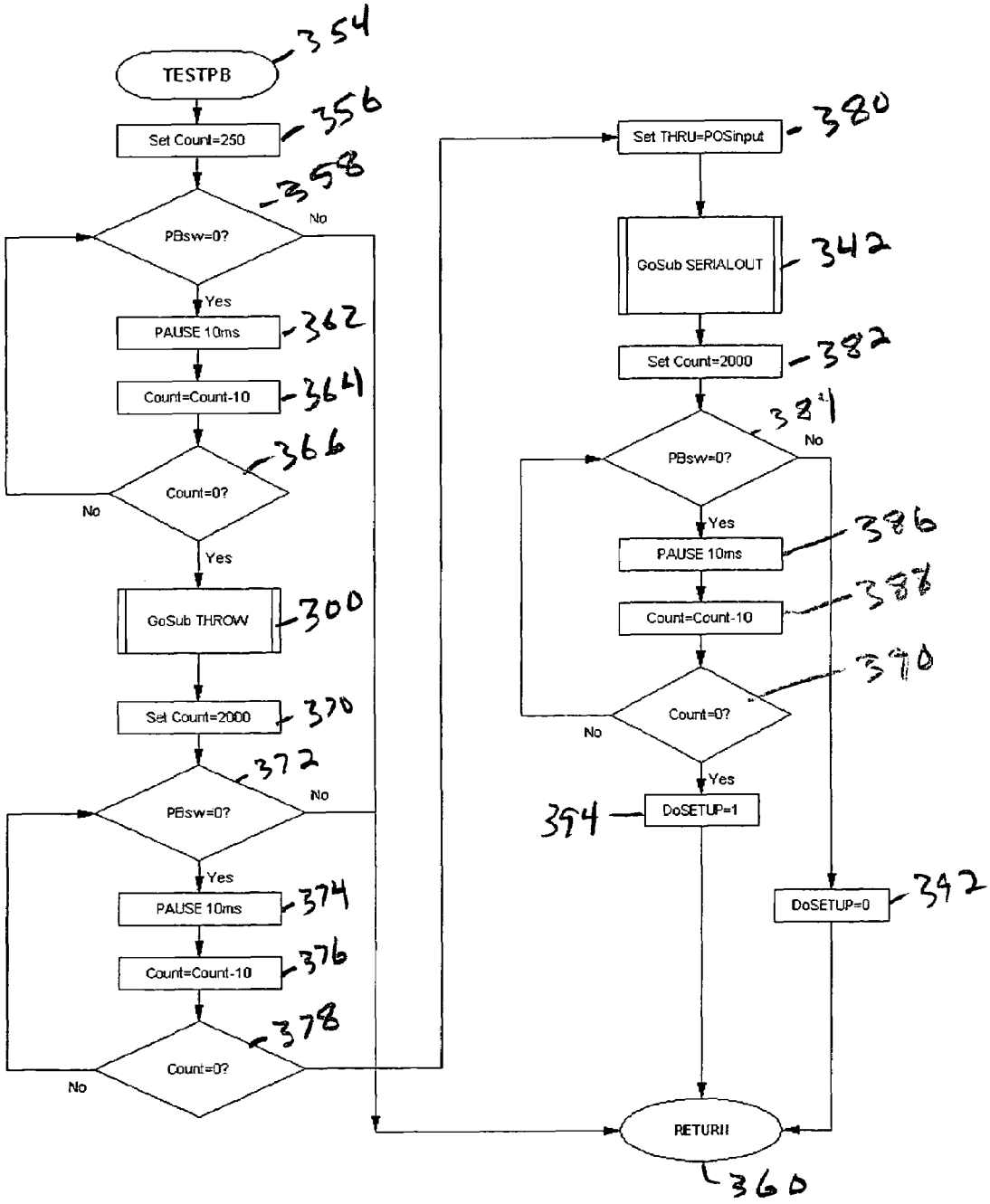
Figure 14:
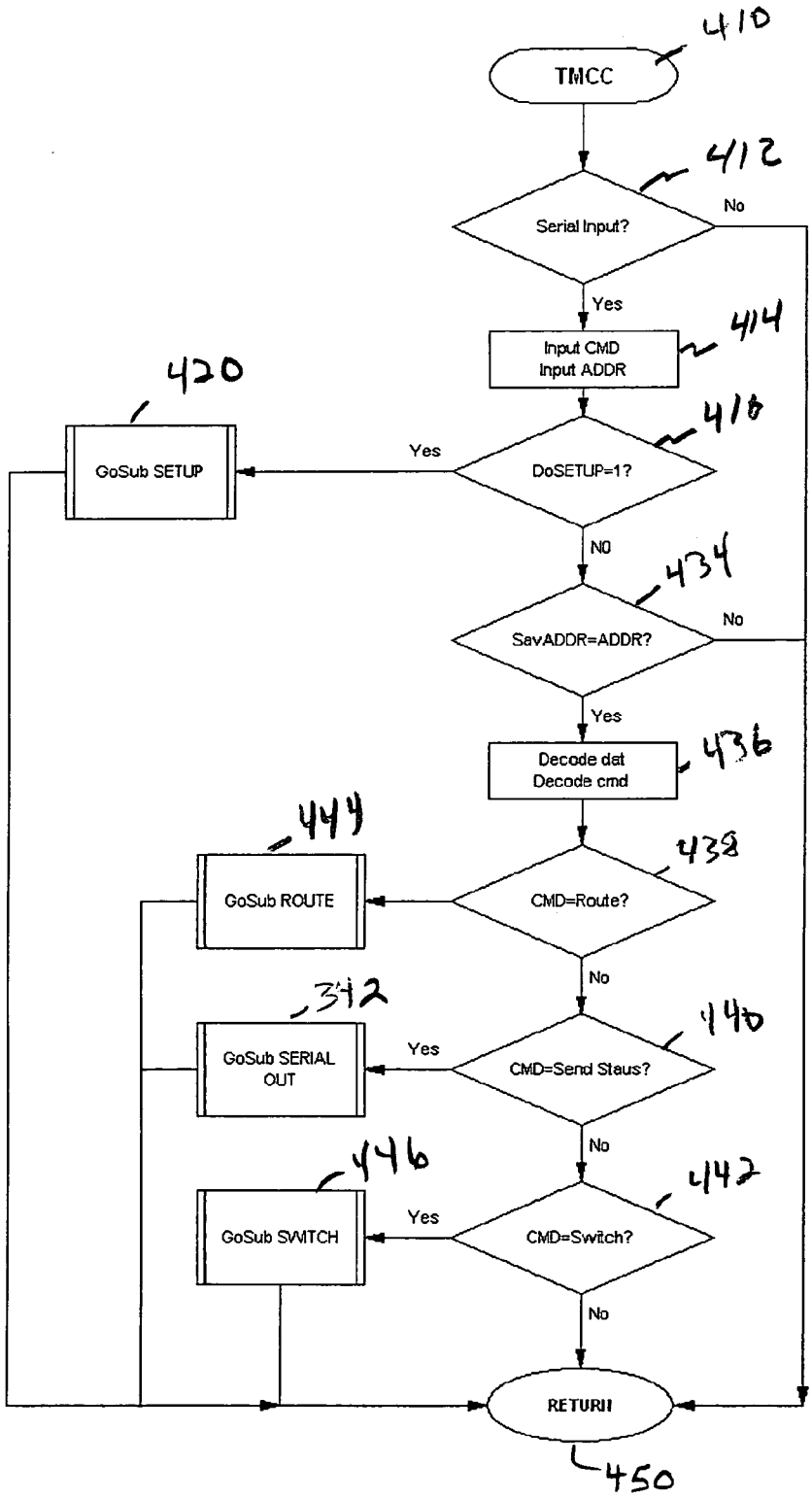
FIG. 14 is a flow chart of the subroutine TESTPB shown in FIG. 11.

The main program loop is now started at 280. The main loop branches to four sub-routines as shown in FIGS. 12, 13 and 14, it being noted that the sub-routines fast throw and throw are both illustrated in FIG. 12.

Figure 15:
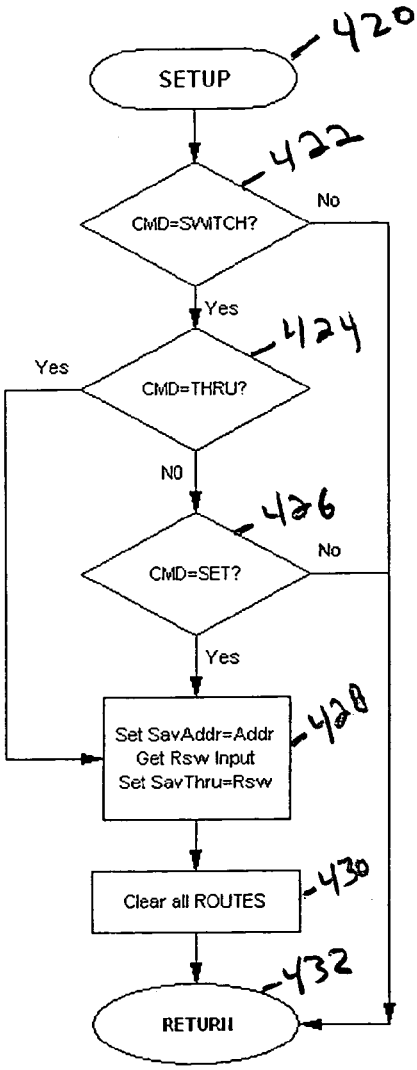
FIG. 15 is a block diagram of the set-up subroutine.
Figure 16:
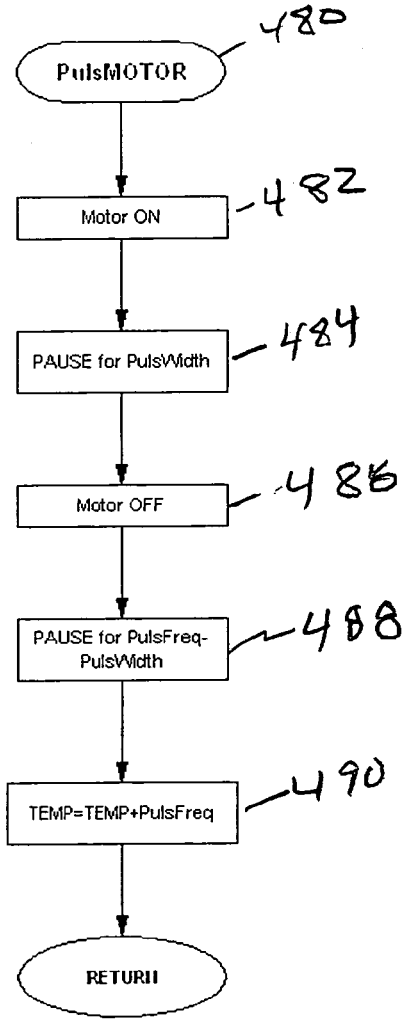
FIG. 16 is a block diagram of a subroutine for controlling the motor.

Further sub-routines as will be described in more detail below are shown at FIGS. 15 and 16.

Commencing at 282, the motor pulse frequency is initially set to fast. Isolated rail segments Rpin and Lpin are then compared to the switch position so that when the train wheels touch the isolated rail the switch is thrown to the correct position for the approaching train if the switch is not already in that position to avoid a derailment. The pulse frequency is set to fast so that the switch can be moved to the correct position before the train gets to the switch point and derails.

Figure 12:
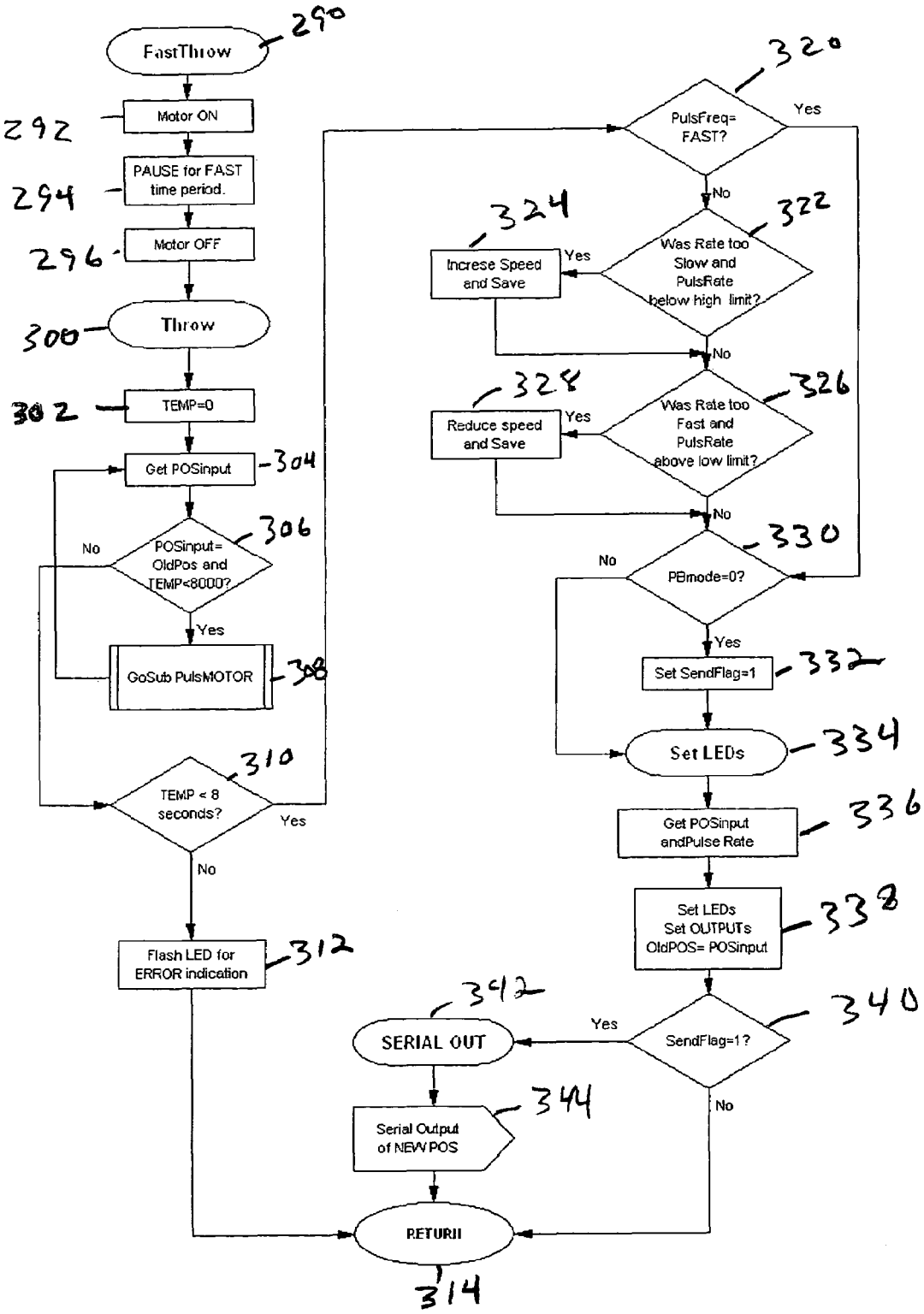
FIGS. 12 and 13 are flow charts showing certain subroutines of the flow chart of FIG. 11.

Sub-routine fast throw is shown at FIG. 12. Fast throw is entered at 290. The motor is turned on for a time determined by the FAST variable set at block 262 and then turned off as shown in steps 292, 294 and 296. The length of the fast time period is established by the FAST variable and is proportional to the voltage available for the motor. These steps move the switch almost completely to the desired position.

The sub-routine for controlling the motor is shown at FIG. 16. The routine enters at 480 and the motor is turned on at 482. The motor remains at 484 for a time equal to the pulse width variable the setting of which has already been described and is turned off at 486. The motor remains off for a time equal to the pulse frequency minus the pulse width at 488, the temporary variable is incremented by the pulse frequency at 490 and the sub-routine returns.

The throw sub-routine is entered at 300. The position of the switch is used to set the pulse rate for the motor for throwing the switch to the opposite position. Preferable, two separate pulse rates are stored because the resistance to movement of the switch may be different in a different direction and preferably, the speed of movement will be as close to the same as possible for both directions of movement. A timer variable temp is set to zero at 302 and the position of the switch is tested at 304. The actual position of the switch is then sensed by reading the resistance between contacts 110 and 112. If the contacts are open, a first switch position is indicated. If the contacts are shorted a second switch position is indicated. If the switch has not reached the new position at 306 and the timer has not reached 8000 (5 seconds) the motor is pulsed at 308. Once the switch has completed it's change to the new position or more than 5 seconds has elapsed, as tested at 310, the red led is flashed to indicate an error at 312. The sub-routine then returns at 314.

If the switch is successfully moved in less than 5 seconds then an adaptive switching rate routine is entered at 320. If the pulse frequency was set to slow and the pulse rate is set below the high limit as tested at 322 then the pulse rate is incremented up and saved at 324. If the rate was too fast and the pulse rate was above the low limit as tested at 326, then the pulse rate is reduced and saved at 328. Thus each time the switch is moved, the rate is adjusted to try to keep a constant speed of operation even as the switch characteristics change over relatively long periods of time.

If the push button mode is zero indicating that the push button is not being used to control the switch then the send flag is set at 332. In either case, the leds are set to indicate the proper switch position at 334.

The position of the switch and pulse rate are sensed at 336 and the leds are set accordingly at 338.

The send data flag is tested at 340 and if it is set, the serial output routine is entered at 342 and data indicating the new position of the switch is sent on the serial output pin at 344. If the send data flag is not set or at the end of the serial output step the sub-routine returns at 314.

Returning now to FIG. 11, if the switch positions are correct, the pulse frequency is set to the slow rate at 350 and the push button switch is tested at 352. If the push button switch is pressed then the test push button sub-routine is entered at 354.

As shown in FIG. 13, a timer is set to 250 at 356 and the push button switch is tested at 358. If the switch is not being pressed the sub-routine returns at 360. The push button switch is de-bounced in a loop including steps 362, 364 and 366 which require that the push button be pressed for at least one quarter second. If the push button is pressed then the throw sub-routine is entered at 300 as already described in connection with FIG. 12.

A two second timing loop including steps 370, 372, 374, 376 and 378 determines whether the push button is held closed for two seconds. If it is not, the sub-routine returns. If it is, then after two seconds the current switch position is set to through at 380 and the output sub-routine 342 is entered which proceeds as already described.

A timer is set for two seconds and the push button switch is tested to determine whether it is held for an additional two seconds, for a total of four seconds in blocks 384, 386, 388 and 390. If the push button is not held for four seconds then the set up flag is set to zero at 392 and the sub-routine returns. Otherwise the set up flag is set at 394 and the sub-routine returns.

Returning to FIG. 11, at block 400 the external push button is read and if the push button mode is set then the throw sub-routine is entered at 300 and the switch is moved to the opposite position at the simulated slow speed.

If the push button mode is not set or the external push button is not depressed then the loop returns to start 280. If the push button mode is not selected and the external push button is pressed then the serial input sub-routine TMCC is entered at 410.

If no data input is detected on pin D input the sub-routine returns at 450. If the input is control input as tested at 414 then the set up flag is checked at 416 and if it is set, the set up sub-routine as shown in FIG. 15 is entered. If a serial input has been received and the switch machine has been put into the set up mode then the serial input will already have been stored and decoded as will be more completely described below. The command is tested at 422 and if it is not a switch command the sub-routine returns.

If the command is not a through command or a set command as tested at 424 and 426 then the sub-routine returns. If the command is a through command or a set command the current switch position as sensed on the position input pin will be saved as the through position in volatile and non-volatile memory. The address received as data will be set as the address of the switch machine at 428, all routes will be cleared at 430 and the sub-routine returns.

If the set up mode is not set at 416 then the address is checked at 434. If the address is not the address of the switch machine, the sub-routine returns at 450. If the address is the address for the switch machine then the command and data are decoded at 436 and the command is tested at 438, 440 and 442. If a route command is received the route sub-routine shown in FIG. 16 is entered. If a send status command is received than the serial output routine is entered at 342 and proceeds are already described. If the switch command is detected than the switch sub-routine is entered at 446. Otherwise the sub-routine returns.

Figure 17:
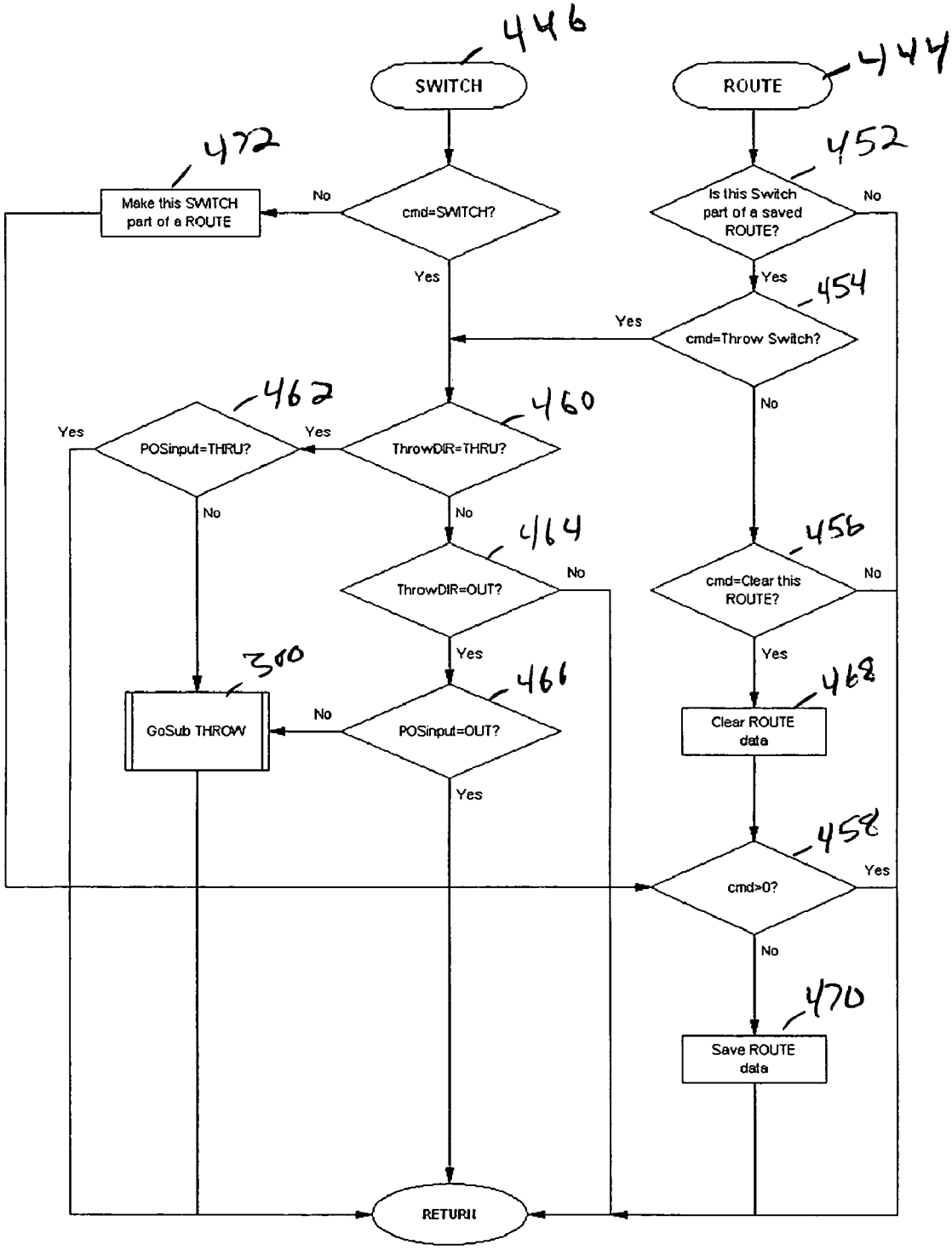
FIG. 17 is a block diagram of the Route subroutine.

Referring to FIG. 17, if a route command is received the route data is checked and if this switch is not a part of a saved route the sub-routine returns. If the switch is a part of a saved route then the command is tested at 454, 456 and 458. If the command is a throw switch command then the throw direction is tested at 460 and compared with the current switch position. If the throw direction and the switch position do not match as tested at 460 and 462 and at 464 and 466 then the throw sub-routine is entered at 300 and the switch position is changed whereupon the sub-routine returns. If the throw direction and the switch direction correspond then the sub-routine returns immediately.

If the command is a clear route command as tested at 456, the route data is cleared at 468 and a non-volatile data is cleared at 470.

Returning to FIG. 14, if the command is a switch command the switch sub-routine is entered at 446. If the command is a switch command then the direction is tested at 460 and the switch is thrown or not thrown as required. If the command is not a switch command then the switch is made part of a route at 472, flow proceeds to 458 and since the command is not a switch command the route data is saved at 470 and the sub-routine returns.

While the invention has been described in connection with a presently preferred embodiment thereof, those skilled in the art will recognize that many modifications and changes may be made thereto without departing from the true spirit and scope of the invention which accordingly is intended to be defined solely by the appended claims.

The invention claimed is:

1. A switch machine for a model railroad layout comprising:

a motor;

a model railroad switch actuator coupled to the motor and movable between two positions by rotation of the motor;

a sensor coupled to the switch actuator for sensing the position of the switch actuator;

a controller connected to the motor and the sensor, the controller having a power input and first and second control inputs, the controller responsive to a first signal on the first control input to activate the motor to move the switch actuator from a first position to a second position at a slow speed simulating an actual railroad switch, and responsive to a second signal on the second control input to move the switch actuator from a first position to a second position at a fast speed to avoid a derailment.

2. The switch machine of claim 1 in which the motor is a unidirectional motor.

3. The switch machine of claim 1 in which the first and second control inputs comprise a single wire control input.

4. The switch machine of claim 1 in which the controller is responsive to the switch actuator to adjust the motor to obtain a desired slow speed.

5. The switch machine of claim 1 in which the controller is responsive to the power input to adjust the speed at which the motor activates the switch actuator.

6. The switch machine of claim 1 comprising a worm gear attached to the motor and an edge gear coupled to the worm gear.

7. The switch machine of claim 6 comprising a pivotally mounted lever coupled to the edge gear.

8. The switch machine of claim 7 comprising a pin on the edge gear and a camming surface on the lever engaged with the pin.

9. The switch machine of claim 8 comprising a plurality of apertures on the face gear and in which the pin is mounted on a selected one of the apertures.

10. The switch machine of claim 9 in which the sensor is coupled to the edge gear.

11. The switch machine of claim 1 comprising a housing and a pushbutton mounted on the housing and connected to the controller.

12. The switch machine of claim 11 in which the controller is responsive to a first signal from the push button to change the position of the switch actuator.

13. The switch machine of claim 12 in which the controller is responsive to the first signal from the push button to move the switch actuator at the slow speed.

14. The switch machine of claim 1 comprising second and third inputs connected to the controller, the controller responsive to signals on the second and third inputs to move the switch actuator to the first and second positions respectively at the high speed.

15. The switch machine of claim 11 comprising first and second signal lights on the housing.

16. The switch machine of claim 15 in which the controller is responsive to a third signal from the push button switch to synchronize the signal lights with the position of the switch actuator.

17. The switch machine of claim 3 in which the controller is an addressable controller responsive to signals on the single wire input addressed to the controller, and not responsive to signals on the single wire input not addressed to the controller.

18. The switch machine of claim 17 comprising memory connected to the controller and route information stored in the memory.

19. The switch machine of claim 18 in which the controller is responsive to a route signal on the single wire input, and to route information stored in the memory to set the switch actuator to a predetermined position.

20. The switch machine of claim 19 comprising a housing and a pushbutton mounted on the housing and connected to the controller.

21. The switch machine of claim 20 in which the controller is responsive to a signal from the push button to enter a programming mode.

22. A switch machine for a model railroad layout comprising:

a motor;

a model railroad switch actuator coupled to the motor and movable between a first position and a second position by rotation of the motor;

a sensor coupled to the switch actuator for sensing the position of the switch actuator;

first and second signal lights coupled to the sensor;

a controller connected to the motor and the sensor, the controller having one and only one single wire signal input and being responsive to a first signal on the signal input to activate the motor to move the switch actuator from the first position to a second position, and responsive to a second signal on the signal input to synchronize the first and second signal lights with the position of the switch actuator.

23. The switch machine of claim 22 in which the controller is an addressable controller responsive to signals on the signal input addressed to the controller, and not responsive to signals on the signal input not addressed to the controller.

24. The switch machine of claim 23 comprising memory connected to the controller and route information stored in the memory.

25. The switch machine of claim 24 in which the controller is responsive to a route signal on the signal input, and to route information stored in the memory to set the switch actuator to a predetermined position.

26. The switch machine of claim 22 in which the controller comprises a second push button signal input, and the second signal is received by the second input.

27. The switch machine of claim 26 in which the switch machine comprises a housing, and the second push button signal input comprises a push button on the housing.

28. A switch machine for a model railroad layout comprising:

a housing;

a motor within the housing;

a model railroad switch actuator coupled to the motor and movable between a first position and a second position by rotation of the motor;

a sensor coupled to the switch actuator for sensing the position of the switch actuator;

a controller within the housing, connected to the motor and the sensor, the controller having an input and a memory for storing an address, and being responsive to a first signal on the input to activate the motor to move the switch actuator from the first position to a second position, and;

a radio frequency receiver within the housing connected to the input and responsive to signals for switch machines having a plurality of addresses, and wherein the controller is responsive only to signals addressed to the switch machine.

29. The switch machine of claim 28 in which the memory is programmable.

30. The switch machine of claim 28 in which the memory is remotely programmable by way of the radio frequency receiver.

31. A switch machine for a model railroad layout comprising in a switch machine housing:

a motor;

a model railroad switch actuator coupled to the motor and movable between two positions by rotation of the motor;

a controller connected to the motor for activating the motor and for storing route information received from an external source and including an input responsive to control signals for selectively switching the switch actuator between the two positions in response to a switching signal, and switching the switch actuator to a preselected position in response to a route signal and the stored route information.

32. The switch machine of claim 31 in which the control signals comprise data signals and command signals.

33. A model railroad switch machine comprising:

a motor;

a model railroad switch actuator coupled to the motor and movable between two positions by rotation of the motor;

a controller connected to the motor, the controller operating the motor at two speeds, a slow speed and a fast speed, and having a power input and a voltage sensor responsive to voltage on the power input for adjusting the speed of the motor.

34. The model railroad switch machine of claim 33 in which the controller provides power pulses to the motor at adjustable widths or frequencies.

35. The model railroad switch machine of claim 33 comprising a sensor coupled to the switch actuator for sensing the position of the switch actuator; and in which the controller is responsive to the position of the sensor to adjust the speed of the motor in response to the actual time.

* * * * *